United States Patent [19]

Jarvis et al.

[11] 4,088,370

[45] May 9, 1978

[54] HAULAGE ARRANGEMENTS FOR MINERAL MINING MACHINES

[75] Inventors: William Joseph Jarvis, Bestwood, England; Terence Smith, Calgary, Calif.

[73] Assignee: Coal Industry (Patents) Limited, London, England

[21] Appl. No.: 610,394

[22] Filed: Sep. 4, 1975

[30] Foreign Application Priority Data

| | | |
|---|---|---|
| Oct. 4, 1974 | United Kingdom | 43103/74 |
| Feb. 19, 1975 | United Kingdom | 06872/75 |
| Feb. 19, 1975 | United Kingdom | 06971/75 |

[51] Int. Cl.[2] ..... E21C 29/00

[52] U.S. Cl. ..... 299/43; 299/53

[58] Field of Search ..... 299/42, 43, 52, 53, 299/33, 44–46; 165/29 R

[56] References Cited

U.S. PATENT DOCUMENTS

| | | | |
|---|---|---|---|
| 1,435,341 | 11/1922 | Sheal | 105/29 R |
| 1,438,151 | 12/1922 | Watson | 105/29 R |
| 1,534,020 | 4/1925 | Baldwin | 105/29 R |
| 1,711,280 | 4/1929 | Morgan | 299/42 X |
| 3,356,417 | 12/1967 | Heyer et al. | 279/43 X |
| 3,753,595 | 8/1973 | Eickhoff | 299/43 |
| 3,753,596 | 8/1973 | Pentith | 299/43 |
| 3,879,088 | 4/1975 | Sodder, Jr. | 299/33 X |

FOREIGN PATENT DOCUMENTS

| | | | |
|---|---|---|---|
| 961,594 | 6/1964 | United Kingdom | 299/43 |

*Primary Examiner*—Ernest R. Purser
*Assistant Examiner*—William F. Pate, III
*Attorney, Agent, or Firm*—James C. Wray

[57] ABSTRACT

A longwall mining machine traverses to and fro along an articulated track assembly which includes an armoured face conveyor and which is engaged by a driven pinion on the machine body to haul the machine along its path.

23 Claims, 13 Drawing Figures

HAULAGE ARRANGEMENTS FOR MINERAL MINING MACHINES

This invention relates to mining machine or vehicle arrangements in which the machine or vehicle traverses to and fro along elongated paths.

In particular the invention relates to a mining machine or vehicle arrangement in which the machine or vehicle hauls itself to and fro along an elongated track.

It has been proposed for a mining machine having a cutter and arranged to traverse to and fro along an armoured longwall face conveyor to be provided with a vertical driven sprocket supported on the same side of the machine as the cutter so as to engage abutments on a horizontal elongated track component constituted by a roller chain accommodated in a trough secured to the working face side of the conveyor. The machine has a drive motor arranged to drive the sprocket to haul the machine to and fro along the elongated track. A resiliently supported member is provided on the machine to engage beneath the trough with the aim of ensuring that the drive sprocket is maintained in engagement with the elongated track component. The resilient support of the member was intended to allow sufficient movement of the member relatively to the rest of the machine to enable the machine to negotiate undulations in the elongated track assembly. Unfortunately, in order to allow sufficient relative movement of the member for the machine to negotiate undulations commonly encountered in underground installations, the resiliently supported member tended not to ensure that the drive sprocket was always maintained in engagement with the track component. Consequently, such a prior known machine arrangement tended to be unreliable and was never widely exploited. In addition the elongated track was not capable of being "snaked" i.e. advanced in "snake" like manner as in universally adopted mining practice. Instead, all the prior known elongated track including the conveyor had to be advanced en bloc. This restricted the track to a relatively short length. Consequently, the length of the mineral face was relatively short and unsuitable for conventional longwall mining practice in which a flexible track including the face conveyor is necessary.

An object of the present invention is to provide a longwall mining machine arrangement which tends to be more reliable, and to lend itself to longwall mining practice more easily, than the prior known machines.

According to the present invention a mining machine or vehicle arrangement comprises a mining machine or vehicle adapted to haul itself to and fro along an elongated track assembly including abutments and constituted by a plurality of track components arranged longitudinally end to end along the machine or vehicle path, the mining machine or vehicle including a body, a drive motor, at least one pinion supported by the body and drivably connected to the drive motor, and a retaining member for engaging the track assembly to retain the machine on the track assembly, characterised in that the retaining member is fixed relative to the body and in that each track component comprises a rigid assembly providing a series of fixed abutments for sequential drivable engagement by the driven pinion and connector means adjacent to the ends of the series of fixed abutments for securing the track components to adjacent track components, the connector means substantially preventing relative longitudinal movement of the adjacent ends of the two track components in the vicinity of the connector means but permitting limited articulation of the connected track components.

Preferably, the retaining member is arranged adjacent to the driven pinion.

Conveniently, the pinion is drivably engaged by a gear arranged to engage successive abutments on the pinion.

Alternatively, the pinion is drivably mounted on a shaft which drivably supports a gear wheel.

The machine may comprise a cutter for cutting mineral from the mineral face and in which case the pinion may be mounted on the opposite side of the machine to the cutter.

Preferably, further connector means are provided remote from the first mentioned connector means which restricts articulation of the track components to within a preselected maximum amount.

Preferably, the two ends of each rigid assembly are concave and convex, respectively, for co-operation with associated ends on rigid assemblies of adjacent track components.

Advantageously, the series of fixed abutments is constituted by a plurality of parallel rods extending between two plates.

By way of example only, four embodiments of the present invention will be described with reference to the accompanying drawings, in which.

Figure 1:
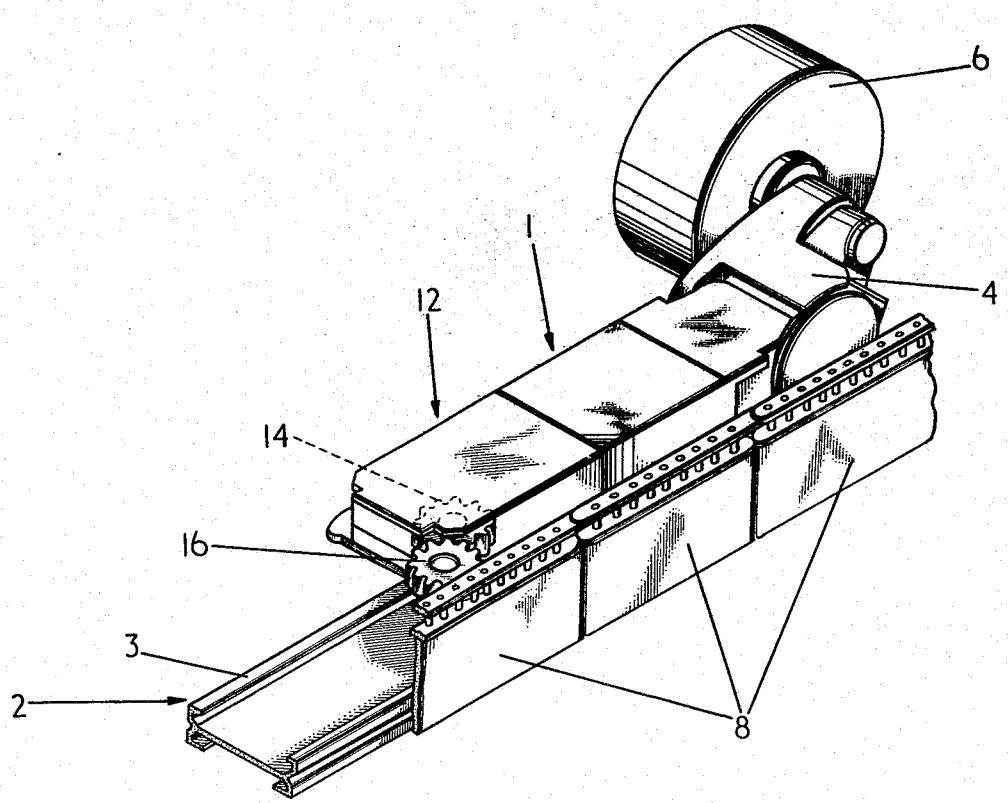
FIG. 1 is a perspective view of a mineral mining machine constructed in accordance with a first embodiment of the present invention and shown mounted on a portion of a track assembly.
Figure 2:
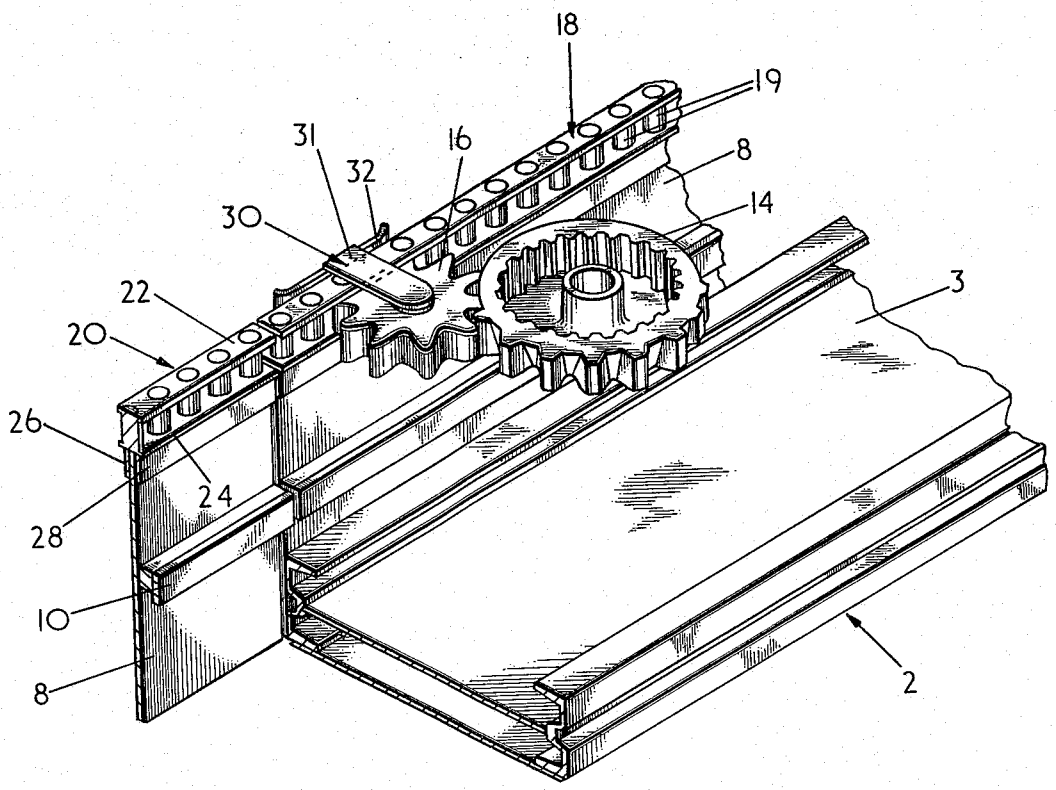
FIG. 2 is an incomplete perspective view of a detail of FIG. 1 on an enlarged scale and viewed from the opposite side of the machine.

Referring to FIGS. 1 and 2 of the drawings, the first embodiment of mineral mining machine 1 (FIG. 1) is shown slidably mounted on an armoured flexible conveyor 2, only a line pad 3 of which is illustrated. The machine 1 has a ranging arm 4 with a rotary cutting drum 6. Mounted adjacent the conveyor 2 and affixed thereto is a series of spill plates 8 each of which is provided with a trapping 10 (see FIG. 2) which, in use, is engaged by a complementary slide member or shoe (not shown) secured to the machine 1.

The machine 1 has a drive assembly 12 which includes a toothed haulage drive wheel 14 driven by drive means constituting part of the machine's body. In meshing engagement with drive wheel 14, there is rotatably mounted a pinion 16 which engages with a track assembly 18 located on the top of the spill plates 8. The track assembly 18 is constituted by a series of track components corresponding to the series of spill plates 8. Each track component comprises a plurality of vertical rods or pins 19 located in spaced relationship, as shown in the figures, in a carrier 20 which has upper and lower plates 22, 24 respectively. The lower plate 24 is provided with extension pieces 26, 28 defining a space between them to allow of the location of the carrier 20 over a marginal edge portion of each spill plate 8. The carrier 20, and thus the track assembly 18, is adjustable vertically in relation to the spill plates to allow for various heights of the pinion 16 to be accommodated depending on the height of the mineral mining machine which corresponds to the thickness of the mineral seam being mined.

In operation, the pinion 16 engages with the pins 19 of the track assembly, and in order to ensure a positive drivable engagement a captivator member 30 has an arm 31 which extends from a support bearing for the pinion 16 over the upper plate 22 of the carrier 20. The arm 31 carries a slide member 32 which is slidable along the side of the track assembly 18 remote from the pinion 16. As the drive means is actuated the drive wheel 14 rotates and causes rotation of the pinion 16 drivably engaging the track assembly 18. This engagement causes the machine 1 to haul itself along the track assembly 18 and, in use, on a mineral face (not shown) to allow the machine 1 and its cutting drum 6 to cut mineral.

As the carrier of the track assembly is releasably mounted on a replaceable spill plate its height can easily be adjusted to suit seam height changes.

The first embodiment of the present invention thus provides a simple and yet effective means of mining machine haulage without the complicated assemblies associated with the hitherto known arrangements.

It is to be understood that whilst a mineral mining machine of the ranging arm shearer type has been depicted other mineral mining machines may also be provided with the haulage arrangement of the present invention.

Figure 3:
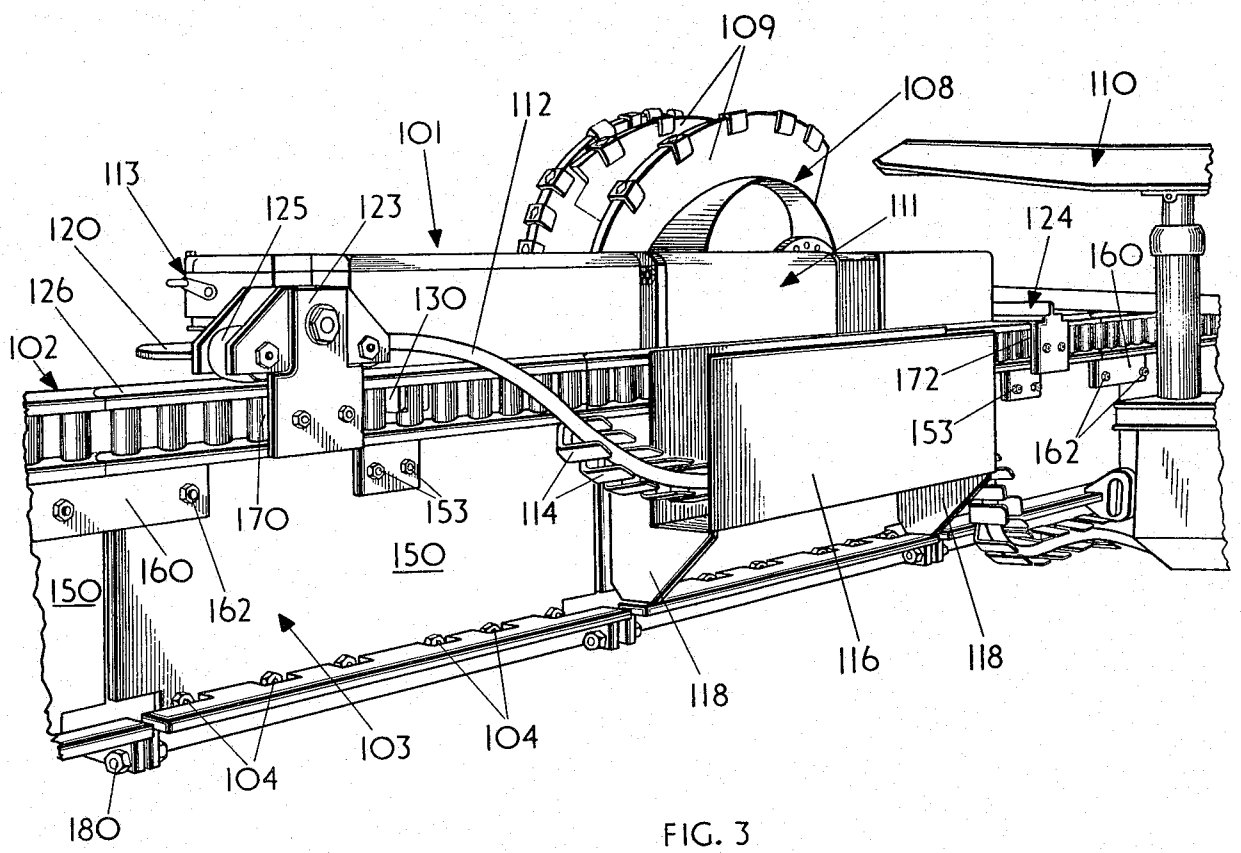
FIG. 3 is an incomplete perspective view of a mining machine constructed in accordance with a second embodiment of mining machine and shown in an operational position.
Figure 4:
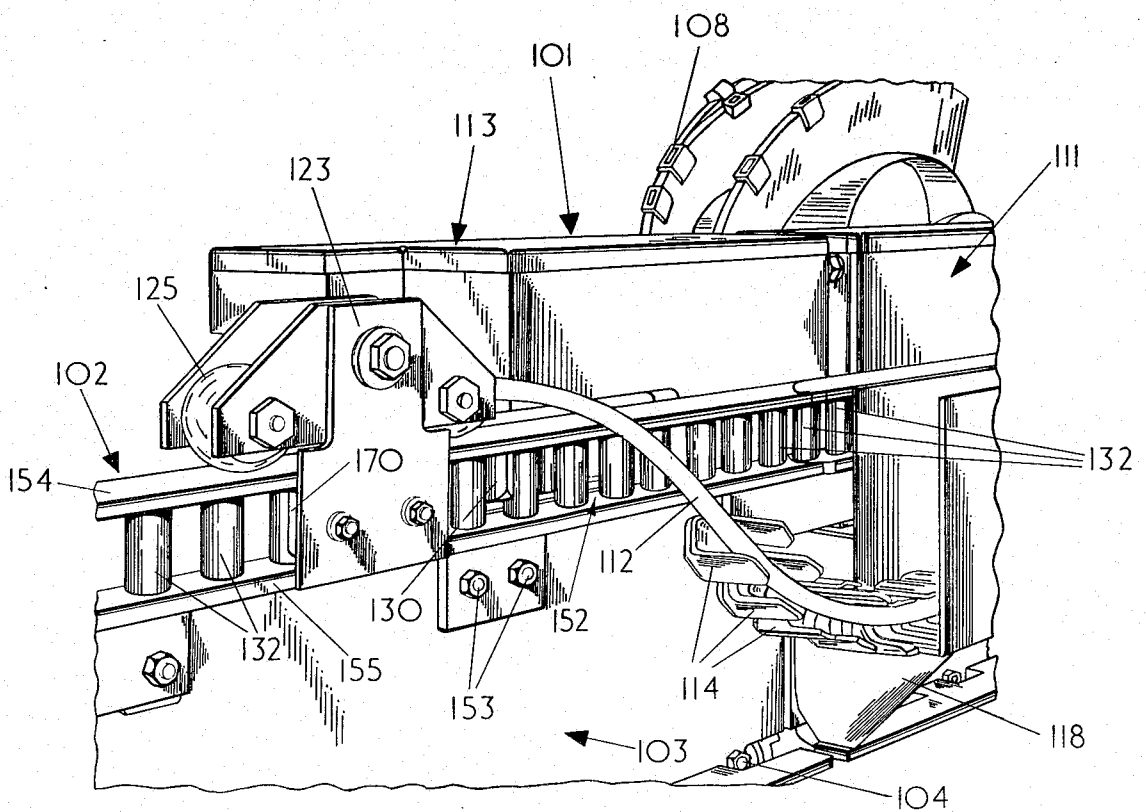
FIG. 4 is an incomplete perspective view of a portion of the machine of FIG. 3, shown on a slightly enlarged scale.
Figure 5:
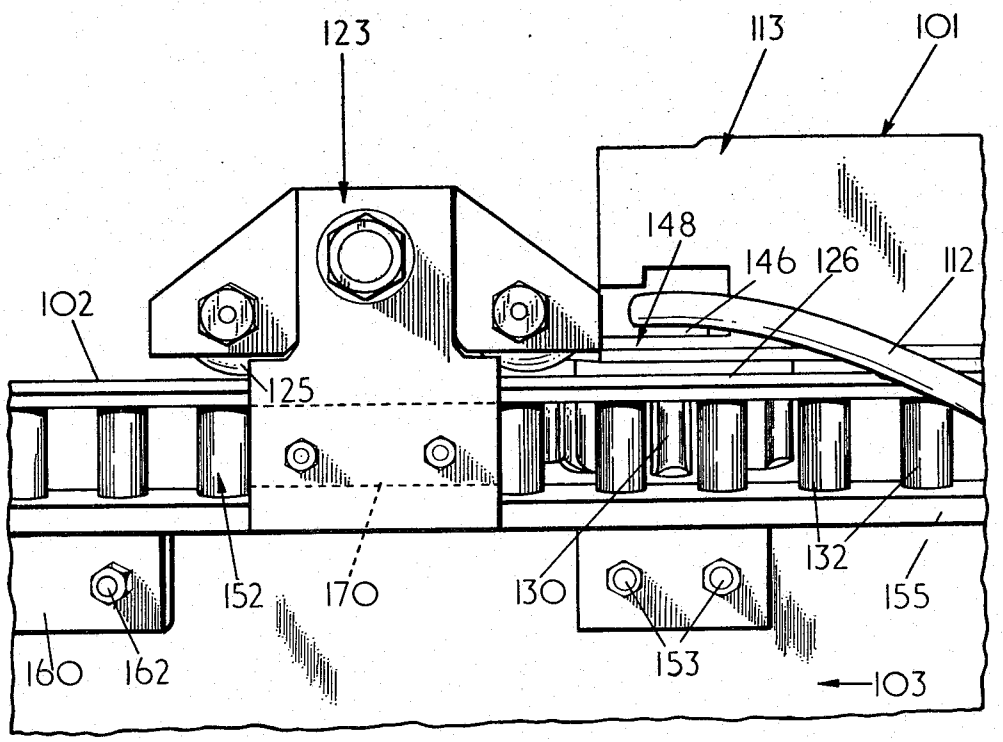
FIG. 5 is a side view of an end portion of the machine of FIG. 3.
Figure 6:
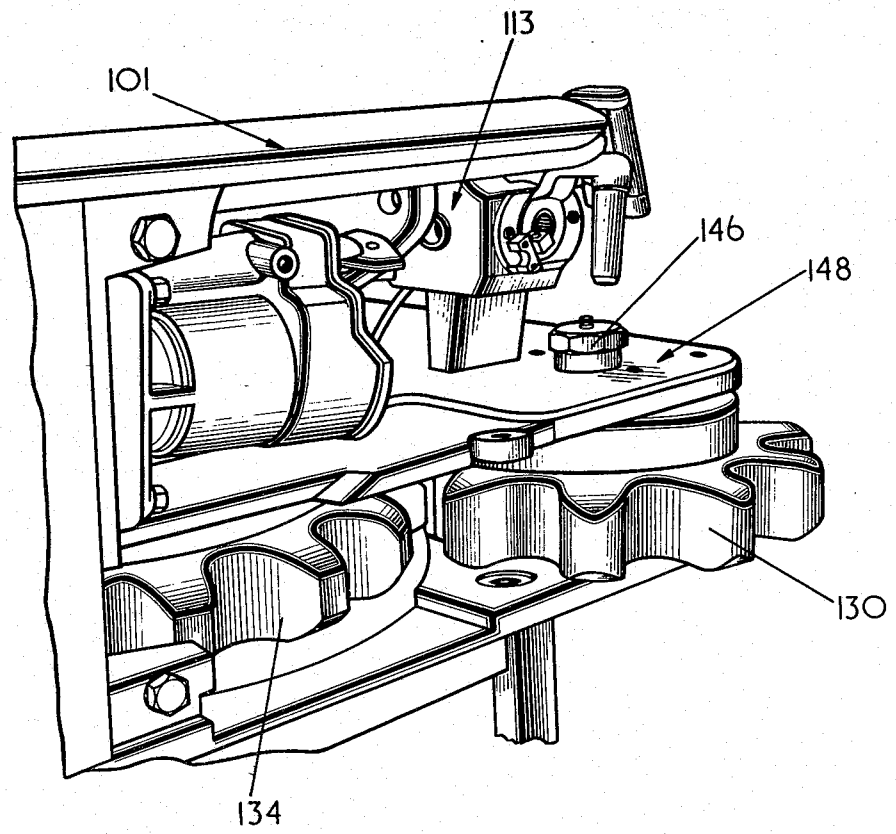
FIG. 6 is a perspective view of a detail of the machine of FIG. 3.
Figure 7:
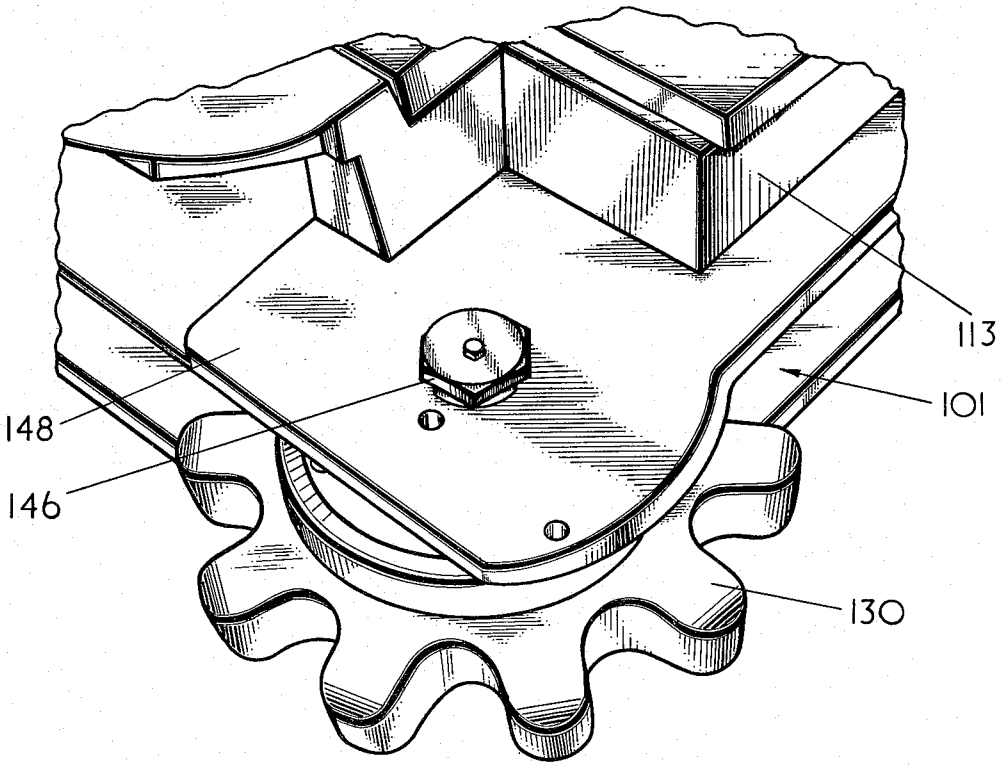
FIG. 7 is a further perspective view of the detail of FIG. 6.

Referring now to FIG. 3 of the drawings which shows a second embodiment of a longwall coal mining machine having a body 101 shown mounted on an elongated track assembly 102 including a plurality of track components 103 arranged end to end and secured by bolts 104 to the goaf side wall of a conveyor (not shown in FIG. 3 but the outline of which is indicated by reference number 105 in FIG. 8) constituted by a plurality of rigid pans articulatedly connected to present an effectively continuous deck which extends the length of the longwall face and over which cut mineral is conveyed by scraper bars hauled by at least one continuous endless driven chain (not shown).

The machine has a rotary cutter 108 arranged to win mineral from the working face as the machine traverses to and fro along the elongated track assembly. Cut mineral is urged by helical loading vanes 109 on the cutter 108 towards the conveyor which conveys the cut mineral along the longwall face towards further conveyor means. As the machine wins mineral the newly exposed mine roof is supported by roof supports 110 (only one of which is shown in FIG. 3) which extend along the length of the longwall face. The machine has a drive motor 111 for the rotary cutter 108 and haulage arrangement 113 which is fed with electric power through a flexible trailing cable 112 supported in chain links 114 (only some of which are shown in FIG. 3) which are guided in a series of troughs 116 (only one of which is shown in FIG. 3) carried on lugs 118 and each secured to a track component 103.

The machine haulage arrangement and the elongated track assembly 102 will now be described in more detail with reference to FIGS. 3 to 11 of the drawings.

Figure 8:
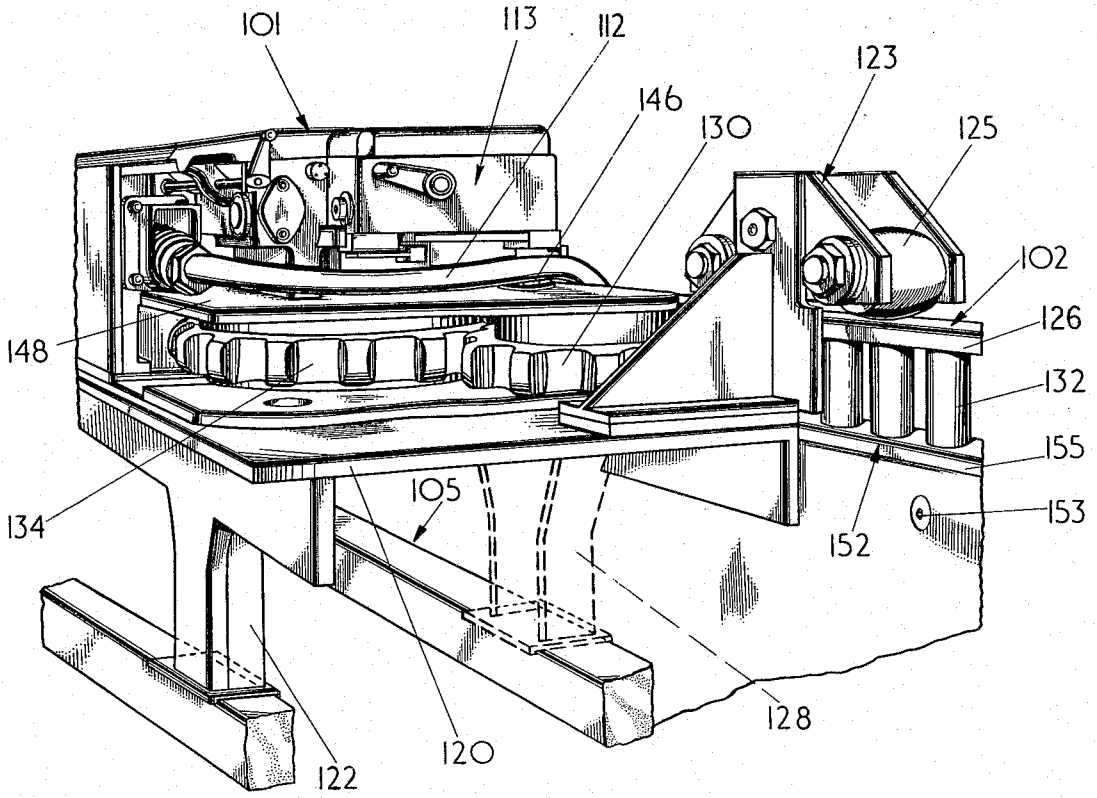
FIG. 8 is an end view of the portion of FIG. 5.
Figure 9:
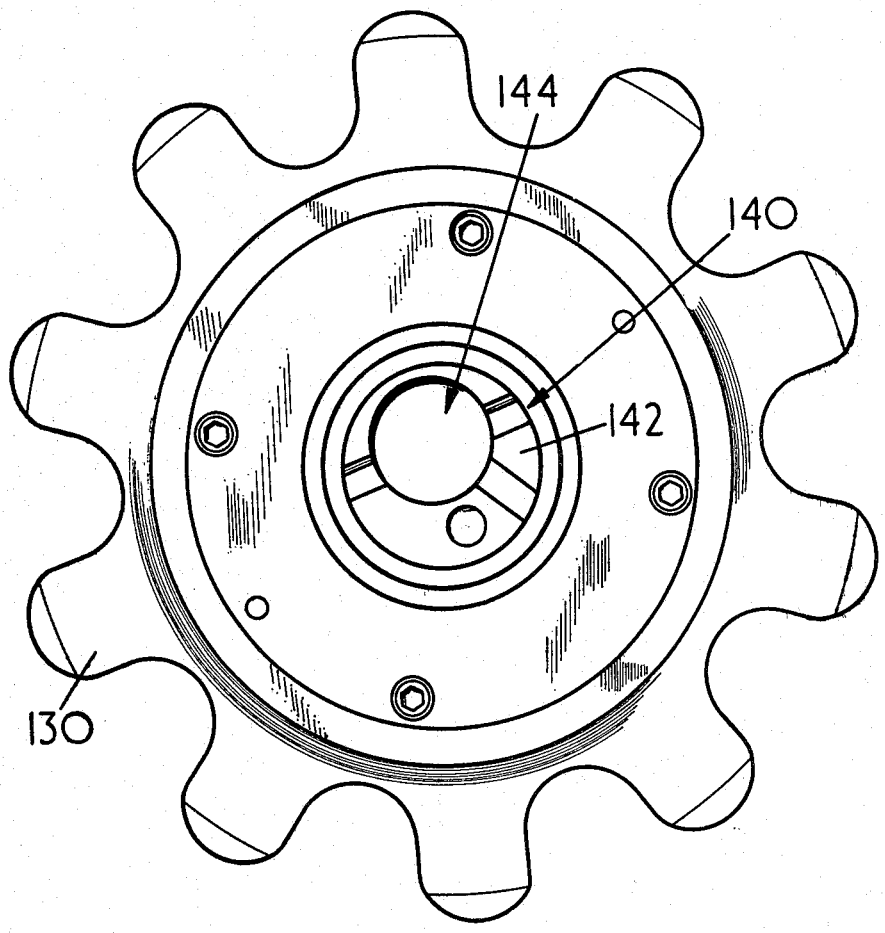
FIG. 9 is a plan of the detail of FIG. 7.
Figure 10:
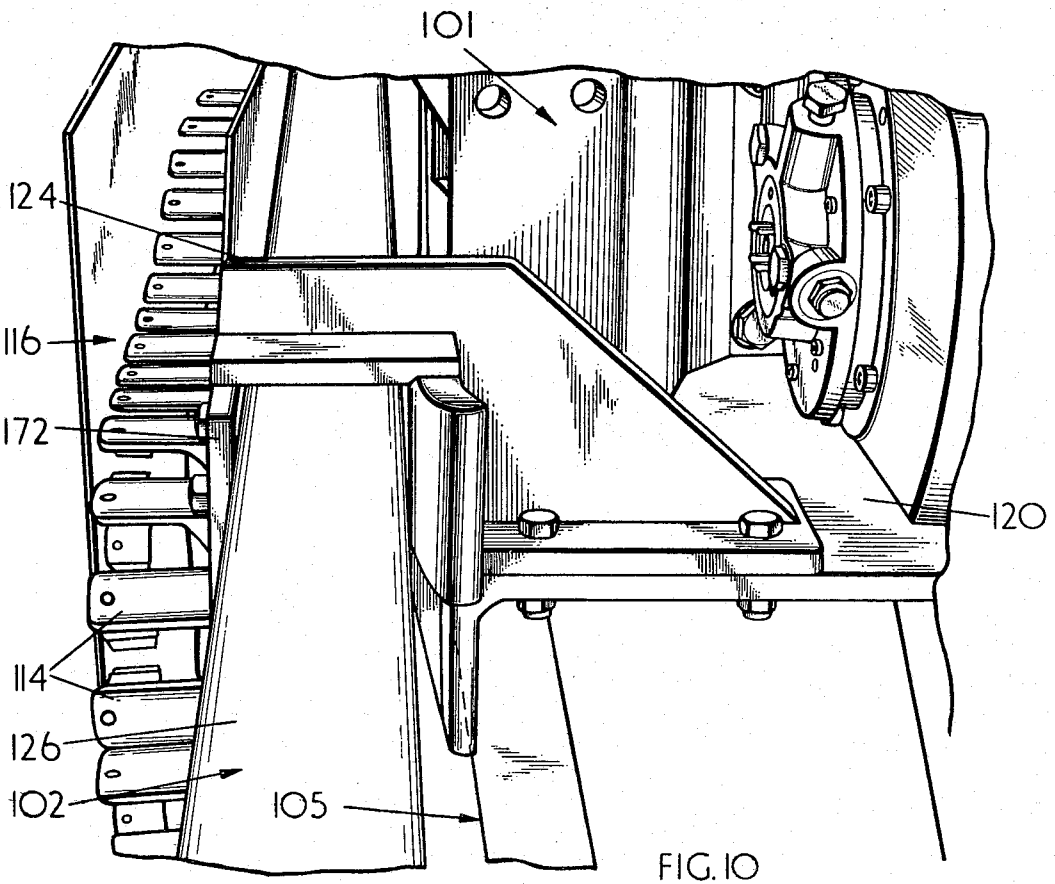
FIG. 10 is an end view of a detail of the machine of FIG. 3 the end being the opposite end of the machine to that shown in FIGS. 4 to 9.
Figure 11:
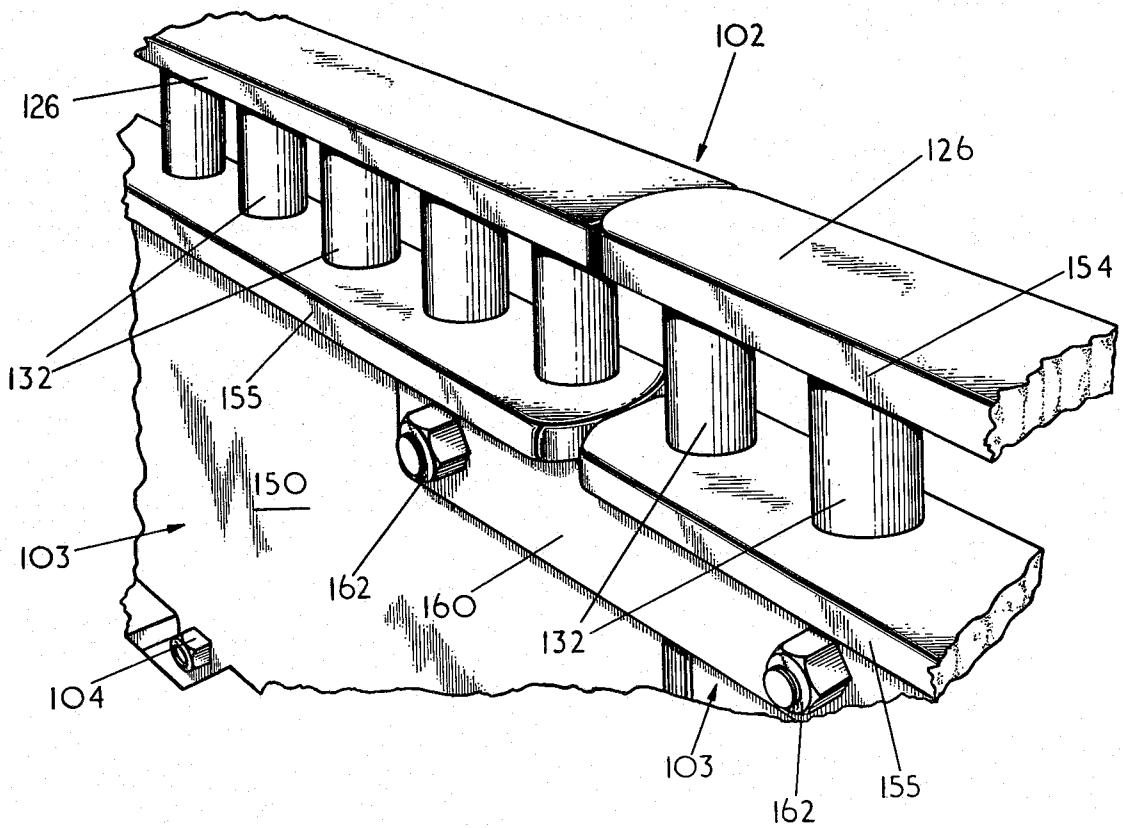
FIG. 11 is a perspective view of a further detail shown in FIG. 3.

The machine body 101 is carried on an underframe 120 which has two legs 122 (only one of which is shown in FIG. 8) slidably engaging on the face side wall of the conveyor 105, a support unit 123 having rollers 125 which engage upper flanges 126 of the track components 103 and a support unit 124 which slidably engages the upper flanges of the track components 103. In an alternative arrangement the units 123, 124 do not carry the machine and instead two additional legs (one of which is indicated by broken lines 128 in FIG. 8) are provided which slidably engage the goaf side wall of the conveyor 105. The support unit 123 is pivotally connected to its support bracket for limited movement about a horizontal axis. This enables the machine to negotiate undulations in its path.

The machine hauls itself along the elongated track assembly 102 by means of a horizontally arranged driven member constituted by a pinion in the form of a toothed wheel 130 which engages abutments provided by a series of vertically arranged pins or rods 132 on the track components 103 and which is drivably engaged by a further pinion in the form of a toothed wheel 134 drivably mounted on a driven shaft provided with a gear wheel drivably geared to the drive motor 111 mounted within the machine body 101 (the drive shaft and gears are not shown).

The toothed wheel 130 is rotatably carried on a sealed bearing assembly 140 (see FIG. 9) which includes a central sleeve 142 having an eccentric bore 144 which is releasably fixedly engaged by a fixed pin 146 supported at both ends by a frame assembly 148 of the haulage arrangement. The position of the sleeve 142 and hence the toothed wheel 130 can be adjusted by temporarily releasing the sleeve 142 from the pin 146 and rotating the sleeve about the pin, the eccentricity of the bore 144 giving rise to the adjustment in the position of the toothed wheel.

The teeth of the toothed wheel 130 mesh with the teeth of the driven toothed wheel 134 and also with the series of vertically arranged rods 132 of the elongated track assembly 102. The rods 132 are arranged on the goaf side of the conveyor 105 remote from the working face and away from the cut mineral conveyed by the loading vanes 109 of the rotary cutter 108 and by the conveyor 105. Hence, the track assembly tends to remain unblocked by pieces of cut mineral.

The rods 132 are in a plurality of sections, each section corresponding to one of the track components 103 comprising an upright plate 150 bolted to the goaf side wall of the conveyor 105 by bolts 104 as previously explained and a rigid rod assembly 152 secured by bolts 153 to the upper margin of the upright plate. The rod assembly 152 comprises spaced upper and lower plates 154 and 155, respectively, and the previously mentioned vertically arranged rods 132 fixedly secured in bores in the plates 154 and 155 and extending between the plates 154, 155. The two ends of the upper plate 154 are formed concaved and convexed, respectively, so that the associated ends of two rod assemblies of two adjacent track components 103 interlock to maintain the rod assemblies in alignment. In addition, the rod assemblies are kept in alignment by connecting link plates 160 secured at their ends by two bolts 162 to two adjacent upright plates 150. The connecting link plates 160 also ensure that adjacent rod assemblies 152 are maintained in a desired relative position so that the rods 132 on both rod assemblies are maintained in pitch for engagement by the teeth of the toothed wheel 130 as the machine hauls itself to and fro along the track assembly 102. In order to facilitate the toothed wheel 130 negotiating joints between adjacent track components the teeth of the toothed wheel 130 have a width substantially less than on the spacing of adjacent rods 132. Thus, any slight variations in the rod spacing encountered at the joints can be accepted and negotiated by the driven toothed wheel 130.

In order to enable the track assembly to negotiate undulations in the longwall face the pans of the conveyor 105 are capable of being spaced by a preselected maximum amount to allow the track assembly limited articulated movement in a generally vertical plane about the bolts 162 of the connecting link plates 160. The conveyor pans, therefore, are connected by means of loosely connected nuts and bolts 180 which permit limited relative longitudinal movement between the ends of the pans. The connecting means also allow the conveyor pans to be snaked or articulated in a generally horizontal plane to permit advance of the conveyor towards the newly formed working face as the machine traverses the longwall face. In order to facilitate articulation of the track assembly 102 the connecting link plates 160 may be made from spring steel.

In order to ensure that the toothed wheel 130 is maintained in engagement with the track assembly, members 170 and 172 are provided on the support units 123 and 124 respectively, for engaging the track assembly 102. The members 170 and 172 are fixed relative to the machine body 101 and allow sufficient operational clearance between the machine body and the track assembly to enable the machine to negotiate typically encountered operational undulations and bends encountered in the track assembly. However, the clearance provided by the members 170 and 172 is not large enough to allow the machine body to move away from the track assembly sufficiently for the toothed wheel 130 to disengage the track assembly i.e. the possible movement of the machine body away from the track assembly is maintained somewhat less than the length of the teeth of the toothed wheel 130. The member 170 is arranged adjacent to the toothed wheel 130 and ensures that the machine haulage arrangement is always maintained in drivable engagement with the track assembly 102.

In the embodiment shown in the drawings the members 170, 172 slidably engage the rod assemblies 152 and project between the upper and lower plates 154 and 155 of the rod assemblies to captivate or trap the machine to the track assembly. Thus, the machine can move freely along the track assembly but cannot become drivably disconnected from the track assembly.

From the above description it can be seen that this embodiment of the present invention provides a relatively simple and reliable haulage arrangement for a mining machine. In modifications the legs 122 are made telescopic to permit steering of the machine in a vertical plane as it traverses along the longwall face.

Figure 12:
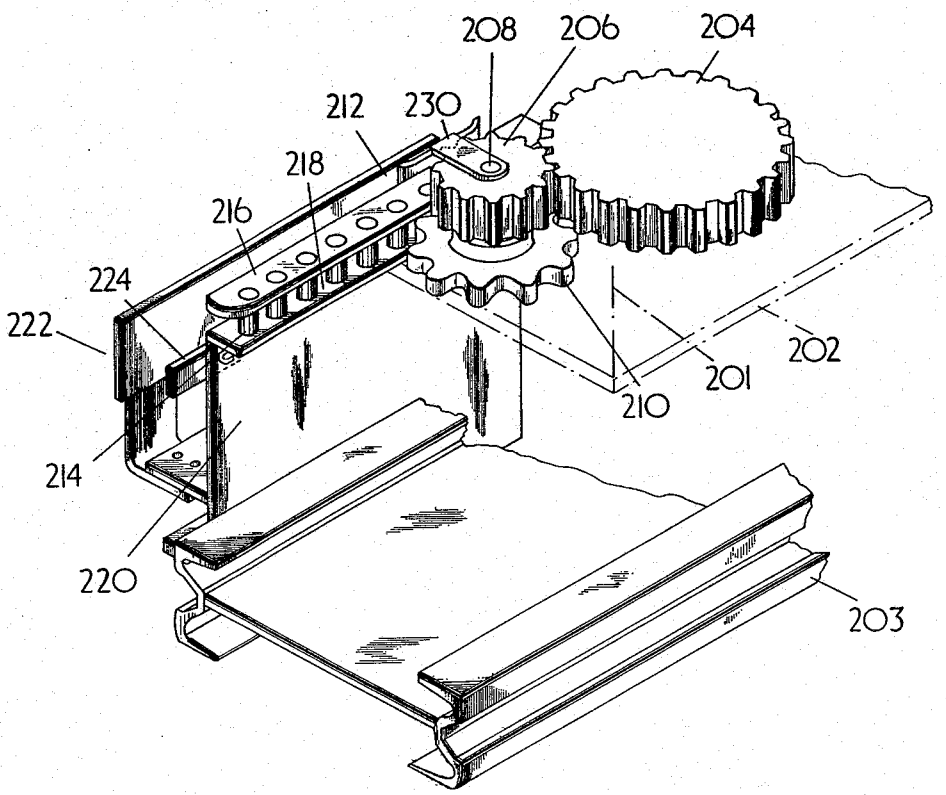
FIG. 12 is an incomplete perspective view of a portion of a mining machine constructed in accordance with a third embodiment of the present invention.

Referring now to FIG. 12 which shows a detail of a third embodiment of mining machine comprising a body 201 (only one end portion of which is shown) supported on an underframe 202 having shoes (not shown) and arranged to traverse to and fro along a longwall face armoured flexible conveyor made up of a plurality of articulatedly connected conveyor sections 203 (only one of which is shown) the machine has a cutter head (not shown) arranged to win mineral from the face as the machine traverses to and fro.

The machine has a drive means drivably engaging a gear wheel 204 carried by the machine which in turn drivably engages a further gear wheel 206 drivably mounted on a shaft 208 along with a pinion 210 arranged to drivably engage a track assembly 212 constituted at least in part by a series of pins or rods 214 extending between upper and lower plates 216 and 218. The lower plate 218 is secured to a vertical spill plate 220 which in turn is releasably secured by means (not shown) to the goaf side of the conveyor section 203. A cable handling trough 222 for electric and/or hydraulic supply cables leading to the machine is secured to the goaf side of the spill plate.

The ends of the upper plates 216 are formed convexed and concaved, respectively, in similar manner to the previously described embodiment to help retain adjacent track components in alignment. Also adjacent vertical plates 220 are connected by connecting link plates 224 in regions adjacent to the pins or rods 214. The connecting link plates maintain the pins or rods of adjacent track components in pitch while permitting sufficient articulation of the conveyor sections to enable the conveyor to be advanced in "snake" like manner and to negotiate undulations in the mine floor.

A captivation member 230 is provided adjacent to the pinion 210 to slidably engage the pins or rods on the side remote from the pinion 210 to retain the pinion in continuous drivable engagement with the track assembly.

In use, the gear wheels 204 and 206 are driven by the drive means within the machine body so that the pinion 210 is rotated in the desired direction, the teeth of the pinion providing a continuous series of abutments which sequentially drivably engage the pins or rods 214 of the track assembly to haul the machine along the longwall face.

It will be appreciated that this embodiment of mining machine has the advantage that the meshing wheels are gear wheels having conventional gear teeth rather than the specially profiled teeth required by the pinion 210 for engaging the pins or rods 214.

Figure 13:
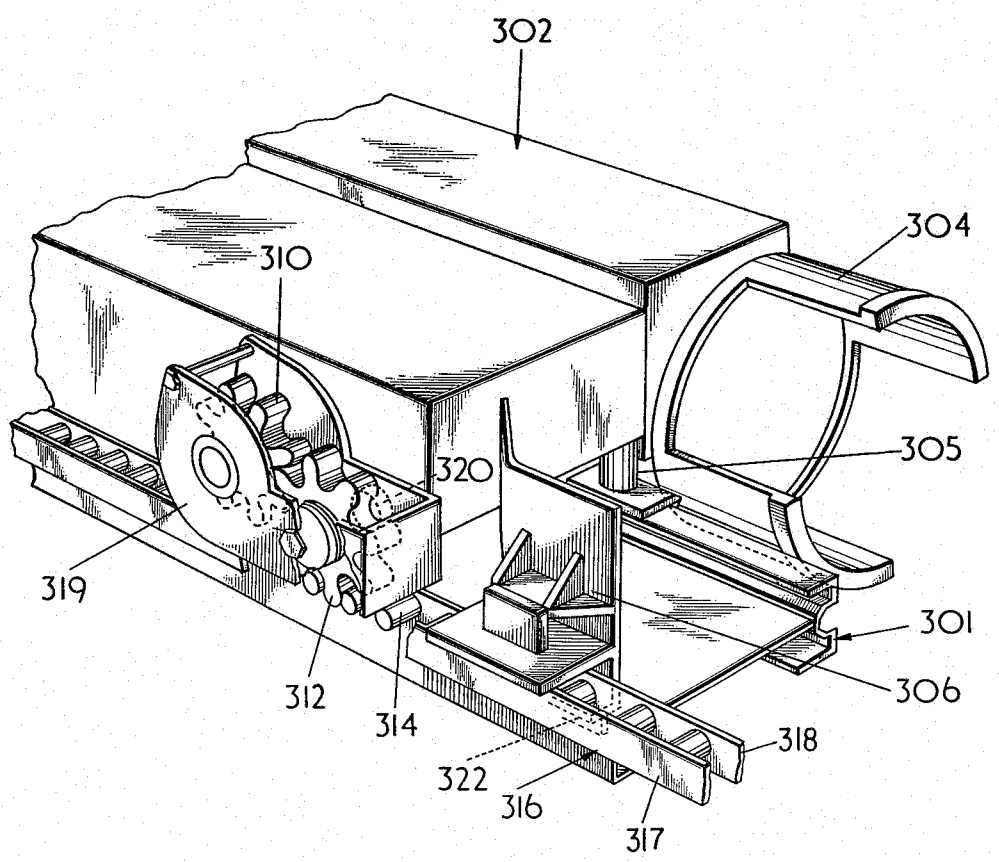
FIG. 13 is an incomplete perspective view of a portion of a mining machine constructed in accordance with a fourth embodiment of the present invention.

Referring now to FIG. 13 which is an incomplete perspective view of a detail of a fourth embodiment of mining machine which is supportly partly on a longwall face conveyor 301 and partly on the mine floor on the working face side of the conveyor.

The machine has a body 302 arranged to traverse to and fro along the longwall face guided by the conveyor and rotary cutter heads 304 (only a part of which is shown) located adjacent to the ends of the machine, respectively. The body 302 is carried on shoes 305 and 306 (only one of each of which is shown) which slide along upper flanges of the conveyor sections. Drive means are provided within the machine body for the cutter heads and for a vertical toothed wheel 301 mounted on the goaf side of the machine body drivably engaging a pinion which is in the form of a vertical toothed wheel 312 and which drivably engages a series of horizontal pins or rods 314 constituting at least a part of a track assembly 316 extending along the longwall face. The pins or rods 314 are secured between two elongated plates and which with the pins constitutes a track component 216 secured to the goaf side of the conveyor section.

The ends of adjacent track components are secured together to maintain the desired pitch between end pins of two track components and to permit limited vertical and horizontal articulation of the track assembly and of the conveyor. The two toothed wheels 310 and 312 are mounted in a framework 319 fixedly secured to the machine body by a locking pin 320.

The shoe 306 adjacent to the toothed wheel 312 has a projecting member or lip 322 which extends beneath the track assembly on the side of the pins or rods remote from the toothed wheel 312 to retain this toothed wheel in continuous drivable engagement with the track assembly.

It is to be understood that whilst a mineral mining machine which is partly supported on the mine floor and partly supported on the conveyor has been depicted other mineral mining machines may also be provided with the haulage arrangement as described with reference to the fourth embodiment of the invention.

In other embodiments the invention provides haulage arrangement for vehicles other than mining machines.

We claim:

1. A mining arrangement comprising a machine or vehicle adapted to haul itself to and fro along an elongated track assembly including abutments and constituted by a plurality of track components arranged longitudinally end to end along the machine or vehicle path, the mining machine or vehicle including a body, a drive motor, at least one pinion supported by the body and drivably connected to the drive motor, and a retaining member for engaging the track assembly to retain the machine to the track assembly, the retaining member being fixed relative to the body, each track component comprising a rigid assembly providing a series of fixed abutments for sequential drivable engagement by the driven pinion, and connector means connected to the track members adjacent to the ends of the series of fixed abutments for securing the track component to adjacent rack components, and further connector means provided remote from the first mentioned connector means, the connector means substantially preventing relative longitudinal movement of the adjacent ends of the two track components in the vicinity of the connector means but permitting limited vertical and horizontal articulation of the connected track components, and restricting articulation of the track components to within a preselected maximum amount, the connector means ensuring that adjacent fixed abutments are maintained in pitch for engagement by the driven pinion.

2. A mining arrangement comprising a machine or vehicle adapted to haul itself to and fro along an elongated track assembly including abutments and constituted by a plurality of trade components arranged longitudinally end to end along the machine or vehicle path, the mining machine or vehicle including a body, a drive motor, at least one pinion supported by the body and drivably connected to the drive motor, and a retaining member for engaging the track assembly to retain the machine to the track assembly, the retaining member being fixed relative to the body, each track component comprising a rigid assembly providing a series of fixed abutments for sequential drivable engagement by the driven pinion, and connector means adjacent to the ends of the series of fixed abutments for securing the track component to adjacent track components, the connector means substantially preventing relative longitudinal movement of the adjacent ends of the two track components in the vicinity of the connector means but permitting limited articulation of the connected track components, wherein the retaining member is directly opposite to the driven pinion.

3. An arrangement according to claim 2, in which the driven pinion is drivably engaged by a gear arranged to engage successive abutments on the driven pinion.

4. An arrangement according to claim 2, in which the driven pinion is drivably mounted on a shaft which drivably supports a driven gear wheel.

5. A mining arrangement comprising a machine or vehicle adapted to haul itself to and fro along an elongated track assembly including abutments and constituted by a plurality of track components arranged longitudinally end to end along the machine or vehicle path, the mining machine or vehicle including a body, a drive motor, at least one pinion supported by the body and drivably connected to the drive motor, and a retaining member for engaging the track assembly to retain the machine to the track assembly, the retaining member being fixed relative to the body, each track component comprising a rigid assembly providing a series of fixed abutments for sequential drivable engagement by the driven pinion, connector means adjacent to the ends of the series of fixed abutments for securing the track component to adjacent track components, the connector means substantially preventing relative longitudinal movement of the adjacent ends of the two track components in the vicinity of the connector means but permitting limited articulation of the connected track components, and further connector means remote from the first mentioned connector means to restrict articulation of the track components to within a preselected maximum amount, wherein the two ends of each rigid assembly are concave and convex, respectively, for co-operation with associated convex and concave ends, respectively, on rigid assemblies of adjacent track components.

6. An arrangement according to claim 5, in which each series of fixed abutments is constituted by two plates and a plurality of parallel rods extending between the two plates.

7. A mining machine arrangement comprising a machine adapted to haul itself to and fro along an elongated track assembly including abutments and constituted by a plurality of track components arranged longitudinally end to end along the machine path, the mining machine including a body, a drive motor, a cutter for cutting mineral from a mineral face as the machine traverses to and fro along the track assembly, at least one pinion supported on the opposite side of the body to the cutter and drivably connected to the drive motor, and a retaining member for engaging the track assembly to retain the machine to the track assembly, the retaining member being fixed relative to the body, each track component comprising a rigid assembly providing a series of fixed abutments for sequential drivable engagement by the driven pinion, and connector means connected to the track members adjacent to the ends of the series of fixed abutments for securing the track component to adjacent track components and further connector means provided remote from the first mentioned connector means, the connector means substantially preventing relative longitudinal movement of the adjacent ends of the two track components in the vicinity of the connector means but permitting limited vertical and horizontal articulation of the connected track components and restricting articulation of the track components to within a preselected maximum amount, the connector means ensuring that adjacent fixed abutments are maintained in pitch for engagement by the driven pinion.

8. A mining machine arrangement comprising a machine adapted to haul itself to and fro along an elongated track assembly including abutments and constituted by a plurality of track components arranged longitudinally end to end along the machine path, the mining machine including a body, a drive motor, a cutter for cutting mineral from a mineral face as the machine traverses to and fro along the track assembly at least one pinion supported on the opposite side of the body to the cutter and drivably connected to the drive motor, and a retaining member for engaging the track assembly to retain the machine to the track assembly, the retaining member being fixed relative to the body, each track component comprising a rigid assembly providing a series of fixed abutments for sequential drivable engagement by the driven pinion, and connector means adjacent to the ends of the series of fixed abutments for securing the track component to adjacent track components, the connector means substantially preventing relative longitudinal movement of the adjacent ends of the two track components in the vicinity of the connector means but permitting limited articulation of the connected track components, wherein the track components comprise plural parallel pins secured between first and second elongated plates, and wherein the retaining member comprises an arm mounted on a pinion support and extending therefrom across a plate of the track assembly, and a slide member connected to the arm and extending therefrom along a side of the track assembly opposite the pinion for sliding along the track assembly remote from the pinion.

9. A mining machine arrangement comprising a machine adapted to haul itself to and fro along an elongated track assembly including abutments and constituted by a plurality of track components arranged longitudinally end to end along the machine path, the mining machine including a body, a drive motor, a cutter for cutting mineral from a mineral face as the machine traverses to and fro along the track assembly, at least one pinion supported on the opposite side of the body to the cutter and drivably connected to the drive motor, and a retaining member for engaging the the track assembly, the retaining member being fixed relative to the body, each track component comprising a rigid assembly providing a series of fixed abutments for sequential drivable engagement by the driven pinion, and connector means adjacent to the ends of the series of fixed abutments for securing the track component to adjacent track components, the connector means substantially preventing relative longitudinal movement of the adjacent ends of the two track components in the vicinity of the connector means but permitting limited articulation of the connected track components, wherein the track components comprise the first and second plates and pins secured between the plates and the machine further comprising a pinion support connected to the body and including rollers mounted on the second plate for rolling along the plate and means extending from the support for mounting the pinion adjacent the pins and wherein the retaining means comprises a plate connected to the support opposite the means for mounting the pinion and extending therefrom to a side of the pins remote from the pinion and means connected to the retaining means plate for slidably engaging the pins on a side thereof opposite the pinion.

10. A mining machine arrangement comprising a machine adapted to haul itself to and fro along an elongated track assembly including abutments and constituted by a plurality of track components arranged longitudinally end to end along the machine path, the mining machine including a body, a drive motor, a cutter for cutting mineral from a mineral face as the machine traverses to and fro along the track assembly, at least one pinion supported on the opposite side of the body to the cutter and drivably connected to the drive motor, and a retaining member for engaging the track assembly to retain the machine to the track assembly, the retaining member being fixed relative to the body; each track component comprising a rigid assembly providing a series of fixed abutments for sequential drivable engagement by the driven pinion, and connector means adjacent to the ends of the series of fixed abutments for securing the track component to adjacent track components, the connector means substantially preventing relative longitudinal movement of the adjacent ends of the two track components in the vicinity of the connector means but permitting limited articulation of the connected track components, and further comprising a conveyor and wherein the track components comprise first and second parallel plates and pins supported by the plates and means connecting a first plate to the conveyor and wherein the retaining member extends from a pinion support across the second plate to a side of the pins remote from the pinion.

11. The mining machine arrangement of claim 10 wherein the means for mounting the first plate comprises an upright plate mounted to the conveyor for directing material in the conveyor and dependent means connected to the first plate of the track component for connecting the first plate to the upright plate.

12. The mining machine arrangement of claim 11, wherein the first and second plates are vertically oriented and wherein the pins are horizontally oriented and wherein the body further comprises a support leg resting upon upper edges of the plates, and wherein the retaining member comprises a downward and horizontal extension of a supporting leg which extends beneath a lower edge of one of the first and second plates.

13. A mining machine adapted to haul itself to and fro along an elongated track assembly including abutments, comprising a body, a drive motor, at least one pinion supported by the body and drivably connected to the drive motor, and a member for engaging the track assembly such that in use as the machine or vehicle moves along the track assembly the pinion is retained in engagement with successive abutments on the track assembly, the member being fixed relative to the body.

14. The mining machine of claim 13, in which the member is arranged adjacent to the pinion.

15. The mining machine of claim 13 in which the pinion is drivably engaged by a gear wheel arranged to engage successive abutments on the pinion.

16. The mining machine of claim 13, in which the pinion is drivably mounted on a shaft which drivably supports a gear wheel.

17. The mining machine of claim 13, in which the body is arranged to travel on the track assembly which includes a conveyor, the machine having shoes for engaging the track assembly.

18. A mining machine track component adapted to form part of an elongated track assembly constituted by a plurality of track components arranged longitudinally end to end along a mining machine or vehicle path, the mining machine or vehicle having a driven member for drivable engagement with the track component, comprising a rigid assembly providing a series of fixed abutments for sequential drivable engagement by the driven member, and connector means connected to the track members adjacent to the ends of the series of fixed abutments for securing the track component to adjacent track components, the connector means substantially preventing relative longitudinal movement of the adjacent ends of two track components in the vicinity of the connector means but permitting limited vertical and horizontal articulation of the connected track components, the connector means ensuring that adjacent fixed abutments are maintained in pitch for engagement by the driven member.

19. A mining machine track component adapted to form part of an elongated track assembly constituted by a plurality of track components arranged longitudinally end to end along a mining machine or vehicle path, the mining machine or vehicle having a driven member for drivable engagement with the track component, comprising a rigid assembly providing a series of fixed abutments for sequential drivable engagement by the driven member, and connector means adjacent to the ends of the series of fixed abutments for securing the track component to adjacent track components, in use the connector means substantially preventing relative longitudinal movement of the two adjacent ends of two track components in the vicinity of the connector means but permitting limited articulation connector means but perimitting limited articulation of the connected track components, and wherein further connector means are provided remote from the first mentioned connector means which restricts articulation of the track components to within a preselected maximum amount.

20. A mining machine track adapted to form part of an elongated track assembly constituted by a plurality of track components arranged longitudinally end to end along a mining machine or vehicle path, the mining machine or vehicle having a driven member for drivable engagement with the track component, comprising a rigid assembly providing a series of fixed abutments for sequential drivable engagement by the driven member, and connector means adjacent to the ends of the series of fixed abutments for securing the track component to adjacent track components, in use the connector means substantially preventing relative longitudinal movement of the two adjacent ends of two track components in the vicinity of the connector means but permitting limited articulation of the connected track components, and wherein the two ends of each rigid assembly are concave and convex, respectively, for co-operation with associated ends on rigid assemblies of adjacent track components.

21. A track component as claimed in claim 18, in which the series of fixed abutments is constituted by a plurality of parallel rods extending between two plates.

22. A track component as claimed in claim 18 for use with a mining machine having a cutter extending towards a working mineral face and arranged to traverse to and fro along an armoured longwall face conveyor including a plurality of pans arranged end to end, the conveyor constituting a part of the elongated track assembly with the rigid assembly securable to the side wall of a conveyor pan remote from the working face.

23. A mining arrangement comprising a machine or vehicle adapted to haul itself to and fro along an elongated track assembly including abutments and constituted by a plurality of track components arranged longitudinally end to end along the machine or vehicle path, the mining machine or vehicle including a body, a drive motor, at least one pinion supported by the body and drivably connected to the drive motor, and a retaining member for engaging the track assembly to retain the machine to the track assembly, the retaining member being fixed relative to the body, each track component comprising a rigid assembly providing a series of fixed abutments for sequential drivable engagement by the driven pinion, connector means connected to the track members adjacent to the ends of the series of fixed abutments for securing the track component to adjacent track components, the connector means substantially preventing relative longitudinal movement of the adjacent ends of the two track components in the vicinity of the connector means but permitting limited vertical and horizontal articulation of the connected track components, the connector means ensuring that adjacent fixed abutments are maintained in pitch for engagement by the driven pinion, and further connector means remote from the first mentioned connector means to restrict articulation of the track components to within a preselected maximum amount.

* * * * *